US009334453B2

(12) United States Patent
Chalabi et al.

(10) Patent No.: US 9,334,453 B2
(45) Date of Patent: May 10, 2016

(54) MATERIAL PROCESSING

(75) Inventors: Rifat Al Chalabi, Nottingham (GB); Ophneil Henry Perry, Nottingham (GB); John Turner, Nottingham (GB)

(73) Assignee: Chinook End-Stage Recycling Limited, Nottingham (GB)

( * ) Notice: Subject to any disclaimer, the term of this patent is extended or adjusted under 35 U.S.C. 154(b) by 350 days.

(21) Appl. No.: 14/128,181

(22) PCT Filed: May 23, 2012

(86) PCT No.: PCT/GB2012/000456
§ 371 (c)(1),
(2), (4) Date: Mar. 28, 2014

(87) PCT Pub. No.: WO2012/175908
PCT Pub. Date: Dec. 27, 2012

(65) Prior Publication Data

US 2014/0215921 A1 Aug. 7, 2014

(30) Foreign Application Priority Data

Jun. 21, 2011 (GB) ..... 1110462.7

(51) Int. Cl.
*C10J 3/86* (2006.01)
*C10B 7/14* (2006.01)
(Continued)

(52) U.S. Cl.
CPC ... *C10J 3/86* (2013.01); *C10B 7/14* (2013.01); *C10B 49/02* (2013.01); *C10B 57/10* (2013.01);
(Continued)

(58) Field of Classification Search
CPC ..... C10B 49/02; C10B 57/10; F26B 21/08; F26B 21/086; F26B 25/06
See application file for complete search history.

(56) References Cited

U.S. PATENT DOCUMENTS 3,950,146 A * 4/1976 Funk ..... B01J 3/02 110/101 R
5,064,444 A * 11/1991 Kubiak ..... C10J 3/54 48/202

(Continued)

FOREIGN PATENT DOCUMENTS

CN 1530621 A 9/2004
CN 1761852 4/2006

(Continued)

OTHER PUBLICATIONS

Chinese Office Action; dated Dec. 2, 2014; 5 pages.

(Continued)

*Primary Examiner* — Matthew Merkling
(74) *Attorney, Agent, or Firm* — Stetina Brunda Garred & Brucker

(57) ABSTRACT

According to this invention there is provided a method of processing material such as organically coated waste and organic materials including biomass, industrial waste, municipal solid waste and sludge, the method comprising: attaching a material container cartridge containing material to be processed to a processing chamber; heating the material in a reduced oxygen atmosphere in the processing chamber to produce gas; channeling the gas from the processing chamber to a treatment chamber in which they are heated to destroy any VOC's therein; recirculating gas from the treatment chamber back into the processing chamber; and in a first mode of operation modifying the moisture content of the gas recirculating from the treatment chamber to the processing chamber by passing it through a second material container cartridge containing material to be processed.

17 Claims, 1 Drawing Sheet

(51) Int. Cl.

| | |
|---|---|
| ***C10B 49/02*** | (2006.01) |
| ***C10B 57/10*** | (2006.01) |
| ***C10K 1/08*** | (2006.01) |
| ***F26B 21/08*** | (2006.01) |
| ***C10J 3/00*** | (2006.01) |
| ***C10K 3/00*** | (2006.01) |
| ***F26B 25/00*** | (2006.01) |
| ***C10J 3/72*** | (2006.01) |

(52) U.S. Cl.

CPC *C10J 3/005* (2013.01); *C10J 3/723* (2013.01); *C10K 1/08* (2013.01); *C10K 3/001* (2013.01); *F26B 21/08* (2013.01); *F26B 21/086* (2013.01); *F26B 25/006* (2013.01); *C10J 2300/0909* (2013.01); *C10J 2300/0916* (2013.01); *C10J 2300/0923* (2013.01); *C10J 2300/0946* (2013.01); *C10J 2300/183* (2013.01); *C10J 2300/1807* (2013.01); *F26B 2200/02* (2013.01); *F26B 2200/18* (2013.01)

(56) References Cited

U.S. PATENT DOCUMENTS

| | | | | |
|---|---|---|---|---|
| 8,608,982 | B1 * | 12/2013 | Abughazaleh | C01B 3/16 252/373 |
| 2008/0155899 | A1 * | 7/2008 | Ramamurthy | C10J 3/78 48/77 |

FOREIGN PATENT DOCUMENTS

| | | |
|---|---|---|
| CN | 101561216 | 10/2009 |
| WO | WO2006100512 | 9/2006 |
| WO | WO2009103254 | 8/2009 |

OTHER PUBLICATIONS

Combined Search and Examination Report Under Sections 17 and 18(3) in relation to Application No. GB1110462.7 dated Jul. 27, 2011; 5 pages.

PCT Search Report and Written Opinion of the International Searching Authority in relation to PCT/GB2012/000456 dated Sep. 4, 2012; 14 pages.

* cited by examiner

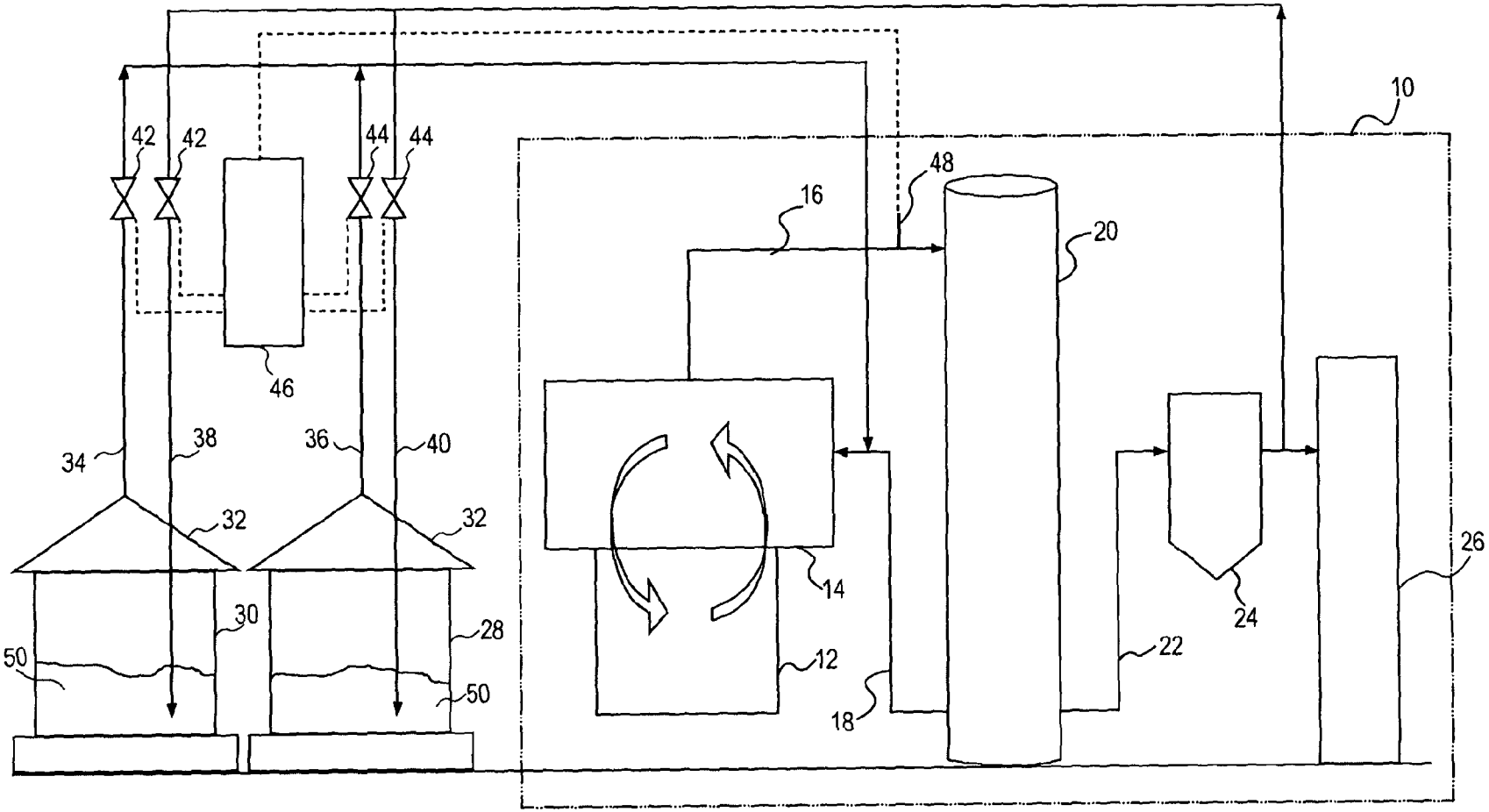
10
26
24
22
20
48
18
16
14
12
44
44
40
32
28
50
36
46
30
32
42
42
38
34
50

MATERIAL PROCESSING

CROSS-REFERENCE TO RELATED APPLICATIONS

The present application claims priority to International Application No. PCT/GB2012/000456 which was filed on May 23, 2012, and claims priority to the Great Britain Patent Application No. 1110462.7 filed Jun. 21, 2011.

BACKGROUND OF THE INVENTION

1. Technical Field of the Invention

The present invention relates to improvements in the processing of material, in particular to improvements in the batch processing of waste to produce syngas or other combustible gasses.

2. Description of the Related Art

The batch processing of material, such as waste, using ovens is documented in the prior art, in particular in patent application WO2006/100512 in the name of Perry et al.

In such methods of material processing, waste material is heated in a large rotating oven in a reduced oxygen environment such that organic components thereof either paralyse or gasify to produce a combustible gas.

This gas is then channelled, via a conduit, into a treatment chamber wherein the temperature of the gasses are raised. In the treatment chamber, the produced gasses may either be incinerated so as to produce a hot exhaust gas from which an energy may be recovered, for example in heat exchange of a boiler, or alternatively the produced gasses may be heated without combusting them to destroy any volatile organic compounds (VOC's) therein, and the resultant synthesis gas, commonly referred to as syngas, can then either be used directly or stored for future use, for example in a syngas engine.

Such apparatus can be used for the treatment of any material containing organic materials, for example biomass, industrial waste or unusable solid waste. Such materials frequently have a high moisture content and, although this does not prevent the process from working, produces its efficiency as, prior to the temperature of the material being processed reaching a temperature at which gasification can occur, the moisture must be driven off from the material. As water has an evaporation temperature of 100° C., the temperature of the material being processed is maintained at a low temperature for a substantial amount of time while the water is driven off prior to gasification or pyrolysis beginning.

Depending on the process parameters, in particular of whether gasification or pyrolysis is occurring, it may be necessary to add water to the system later in the process to produce steam. During a pyrolysis process there is substantially no oxygen present within the system. Accordingly, the carbon released from the material being processed is not burnt and exists in the oven and gas stream as soot. This is partially mitigated by the soot reacting with water released from the material as it is being processed as it reacts, at temperature, with the soot to produce hydrogen and carbon monoxide. However the water release from the material being processed is variable and unpredictable.

It is a purpose of the present invention to, at least in part, mitigate some of the abovementioned problems.

SUMMARY OF THE INVENTION

According to a first aspect of the invention there is provided a method of producing material such as organically coated waste and organic materials including biomass, industrial waste, unusable solid water and sludge, the method comprising: attaching a first material container cartridge containing material to be processed to a processing chamber; heating the material in a reduced oxygen atmosphere in the processing chamber to produce gas; channelling the gas from the processing chamber to a treatment chamber in which they are heated to destroy any VOC's therein; recirculating gas from the treatment chamber back into the processing chamber; and in a first mode of operation modifying the moist content of the gas recirculating from the treatment chamber to the processing chamber by passing it through a second material container cartridge containing material to be processed.

In a preferred embodiment the material in the second material container cartridge is at a temperature below 100° C. such that moisture within the gasses condensates in the second material container cartridge thereby reducing the $H_2O$ content of the gas. The temperature of the material in the second material container cartridge is preferably in the region of 20° C. to 60° C. Preferably, the temperature of the material in the second material container cartridge is raised from its ambient temperature to a temperature not exceeding 65° C. by the recirculating gasses, although it will be appreciated that temperatures in excess of 65° C. will not prevent the system form functioning.

By passing the gasses through the second material container cartridge, which is at a temperature below the condensation temperature of moisture, at least some of the moisture within the recirculating gasses will condense in the second material container cartridge. As the moisture condenses in the second material container cartridge, the temperature of the material therein becomes raised, but is not raised sufficiently that moisture is released from the material therein.

In an alternative method of operation at least some of the material in the second material container cartridge is raised to a temperature of approximately 100° C. so as to evaporate the moisture from the material therein to increase the $H_2O$ content of gas. In this manner by passing the recirculating gasses through the second material container cartridge, the moisture level within the recirculating gasses can be increased.

Preferably, where the method maintains the second material container cartridge at a temperature below 100° C., the method further comprises: in a second mode of operation increasing the H2O content of the gas by passing the gas recirculating from the treatment chamber to the processing chamber through a third material container cartridge. The temperature of the material in the third material container cartridge is preferably raised to a temperature of approximately 100° C. by the recirculating gasses so as to evaporate moisture from therein. In this way the moisture content of the recirculating gas can either be decreased or increased by operating in either the first mode of operation or a second mode of operation.

The method may also further comprise: in a further mode of operation recirculating gas from the treatment chamber directly to the processing chamber. In this way when neither a decrease nor an increase in the moisture content is required the recirculating gas bypasses both the second and the third material container cartridges.

Preferably the method also comprises monitoring the moisture content of the gas and selectively operating in one of the modes of operation to maintain a predetermined moisture content in the gas.

Preferably the method includes monitoring the quality of the gas produced in the processing chamber to identify when the material therein is fully processed. This may include one or more of monitoring the hydrogen content and monitoring the carbon monoxide content of the gas. When, from the monitored gas qualities it is determined that the material in the processing chamber is fully processed, the method preferably further comprises: removing the first material container cartridge from the processing chamber and attaching the third material container cartridge to the processing chamber for processing the material therein. The method preferably further comprises replacing the third material container cartridge with the second material container cartridge and replacing the second material container cartridge with a fourth material container cartridge containing material to be processed at ambient temperature. According to the method described above at times when there is an excess of moisture in the recirculating gasses, the recirculating gasses can be diverted into the second material container cartridge, which has a temperature below the condensation point of the moisture, such that at least some of the moisture in the recirculating gasses will condense in the second container cartridge thereby reducing the $H_2O$ content of the recirculating gasses. As the recirculating gasses are passed through the second material container cartridge, the temperature therein rises but is maintained below 65° C., preferably having a maximum temperature in the range of 60° C. to 65° C. The material processing cartridges are fed through the system such that when the material container cartridge containing the material that is currently being processed has finished its processing cycle, the second material container cartridge containing a mixture of the material to be processed and the condensed water, it then becomes the third material container cartridge. As the temperature of the material therein has already been increased close to its evaporation point while its acting as a condenser it will not take a great deal of input energy for the material within this container cartridge to start to evaporate if its temperature is further increased by the introduction of more recirculating hot gasses (gases that are above 80 C).

In the third container cartridge, which during the processing of the first container cartridge was heated by recirculating gasses to evaporate the water therein to meet the $H_2O$ requirements of the process, the majority of the moisture has now been driven from the material therein and the temperature of the cartridge is at, or above, the evaporation temperature of the water. When the first processing cartridge is fully processed, it is removed from the processing chamber and the third processing cartridge, now containing a minimal amount of moisture and the waste material at a temperature close to 100° C. or above, is attached to the processing chamber and the material therein can be processed.

The previously known cycle, as described in the prior art, where just one cartridge is processed at a time, results in an abundance of water being released as vapour early in the process (as the waste is being heated), which requires a large amount of energy (drying), and gets removed from the process. Post completion of the drying of the waste, the prior art cycle then lacks the moisture that it needs towards the end of the process which then often results in the necessity for injecting moisture to the process (in the form of adding water to the process) or a more sophisticated system is needed to condense, filter and clean the moisture from the waste that was released so as to be available for re-use again. In the previous process where this was necessary the energy for condensing the water to remit from the system and for evaporating the water to add it back into the system were lost. In the present invention as the condensing and evaporating is done within material container cartridges immediately prior to their being processed, the heat is retained in these cartridges and is not lost from the system. Furthermore, as the majority of the moisture has been driven off from the material before it is processed, the time taken to bring the material in the container cartridge that has been attached to the processing chamber up to processing temperature is much reduced due to the reduced amount of moisture within this material, thereby increasing the cycle efficiency of the system.

A further advantage of removing the majority of the moisture from the material to be processed prior to attaching the material container cartridge to the processing chamber is that in some waste streams, in particular in remissible solid waste, the moisture content thereof can contribute to up to 50% of the mass of the waste. As, in processing ovens as described in the prior art, there is a maximum mass of material that can be processed at a single time, by reducing the moisture content prior to attaching the container cartridges to the processing chamber, a greater amount of dry material can be processed in each cycle.

A further advantage of using the dual cartridges to condense and evaporate the moisture, is that in the previous process, the captured waste moisture would need to be condensed in a separate container, which would require filtering and cleaning prior to injecting again into the process. In the current process; this is done in the container cartridge, and the moisture is maintained in the process by balancing the condensation and evaporation without having to collect the water. As the water is condensed in the waste container cartridge and is again evaporated directly therefrom the necessity of filtering and treating in the storage tank before re-use in the process is avoided, thereby reducing capital cost, operating cost and system complexity.

According to a second aspect of the invention there is provided an apparatus for processing material such as organically coated waste and organic materials containing: biomass, industrial waste, remissible solid waste and sludge, the apparatus comprising: a first material container cartridge containing material to be processed; a processing chamber that receives the first material container cartridge for processes and material therein at an elevated temperature to produce gas; a treatment chamber for heating the gas so as to destroy VOC's therein; a first conduit means between the treatment chamber and the processing chamber for recirculating hot gasses from the combustion chamber to said processing chamber; a second material container cartridge containing material to be processed; a second conduit means between the treatment chamber and the processing chamber having the second material container cartridge therein; control valve means to selectively direct the gasses from the treatment chamber through the first conduit or the second conduit; and a controller to modify the moisture content of the gas by selectively diverting it through the second conduit means.

The apparatus may further comprise: a third material container cartridge containing material to be processed; a third conduit means between the treatment chamber and the processing chamber having a third material container cartridge therein; wherein the control valve means also selectively directs the gasses from the treatment chamber through the third conduit means; and the controller is configured to decrease the moisture content of the gas by selectively diverting it through the second conduit means and to increase the moisture of the gas by selectively diverting it through the third conduit means.

The apparatus may further comprise a moisture sensor for detecting the moisture content of the gas circulated in the system. Preferably, the controller is configured to operate the valve means to maintain a predetermined moisture content throughout the process cycle. The controller receives signals from the moisture sensor indicative of the moisture content (which may be directly or indirectly measured) of the gas circulating in the system and, by comparing the actual calculated moisture content to a predetermined desired moisture content, the controller operates the control valve means to selectively divert the gas to either increase or decrease the moisture content thereof to achieve the desired predetermined moisture content.

BRIEF DESCRIPTION OF THE DRAWINGS

A specific embodiment of the invention will now be described, by way of example, with reference to the accompanying drawings in which:

FIG. 1 represents a schematic diagram of a system in accordance with the invention.

DETAILED DESCRIPTION OF THE INVENTION

Referring to FIG. 1 the group of items 10 are those of a known method of processing material, for example as shown in International Patent Application No. WO2006/100512. The main components of this system comprise a rotating oven comprising a material container cartridge 12 attached to a processing chamber 14. In use the oven is rotated and the material within the material container cartridge tumbles within the oven and becomes heated. Conduits 16, 18 join the oven to a thermal reactor. The thermal reactor 20 has a burner therein which raises the temperatures of gas circulating through the conduits and by heat transfer through the circulating gas heats the contents of the oven. The thermal reactor 20 also maintains the gasses released from the material being processed at a raised temperature for a dwell period to ensure the destruction of any volatile organic compounds therein.

The thermal reactor 20 may combust the synthesis gasses being produced in the oven or, alternatively, may heat them without combusting them so that they may be used for further use downstream.

The gas exiting the thermal reactor 20 has an alternative flow path 22 that leads to a heat exchanger 24 that could, for example, be a boiler for the production of steam to produce electricity.

Gas exiting the boiler is then passed through a scrubbing system 26 to ensure that it is properly clean. Depending on whether the thermal reactor 20 combusts the synthesis gasses (syngas) produced by the oven or whether it merely heats them the gasses exiting the scrubber will either be exhaust gasses ready for release to atmosphere or alternatively they will be cleaned syngas that can be stored for further use or can be used directly, for example in powering a syngas engine for the production of electricity.

As previously stated this part of the system is known in the art. When operating such systems it is highly beneficial that there is a certain amount of moisture present within the circulating gasses as this moisture reacts with carbon released from the material being processed and prevents a build-up of soot within the system. However, as the water under atmospheric pressure has an evaporation temperature of 100° C., and as the process pressure is slightly above atmospheric pressure, and the gasification temperature of the material being processed is generally well above 100° C., the temperature rise of the oven is retarded when a new cartridge is added by the time taken to convert the moisture within the material in the container into steam. This results in there being a large amount of steam present early in the operation of the system and very little steam present towards the end of the operation of the cycle of the system. It may therefore be beneficial to add water by injecting it into the system later during the cycle so as to prevent the build-up of soot. This abundance of water early in the cycle followed by a shortage of water later in the cycle which may be made up by the introduction of water later in the cycle which introduces inefficiencies into the system.

Furthermore the rotating ovens can only process a certain weight of material at any one time. As a lot of the types of material that it is desirable to process, for example municipal waste, can contain a large percentage of water then this becomes a limiting factor on the throughput of material through the system.

The following description describes how the present invention improves upon this known system.

The system of the invention uses a plurality of material cartridges 12, 28, 30 within the operating system. One of these material containers 12, is attached to the oven and the other two containers 28, 30 are attached at their open other ends to a hood 32 having an extraction conduit 34, 36 and a gas injection conduit 38, 40 attached thereto. An air tight seal is formed between the upper edge of the material containers 28, 30 and the lower surface of the hoods 32. The extraction conduits and the injection conduits each have a valve 42, 44 therein. The valves are controlled by a controller 46 which receives signals from at least one sensor 48. The outlet conduits 34, 36 join the conduit 18 between the thermal reactor and the oven and the inlet conduits 38, 40 are joined to a conduit which branches off the gas flow line between the boiler 24 and the scrubber 26.

The system is operated as follows. During the initial part of the cycle while the material within the container 12 is releasing its water the controller senses an excess of water in the gas circulating through the conduits 16, 18 and opens valves 42 During this part of the processing cycle the temperature is quite low and little gasification of the material occurs so the moisture need of the system is low. After exiting the boiler 24 the gas has a temperature of approximately 90-220° C., although it will be recognised by the skilled person that the output temperature of the boiler will be dependent on the boiler design and duty.

This gas which is carrying moisture passes through valve 42 into the container 30 which is at ambient temperature. When the gas mixes with the material 50 in the container 30 its temperature is reduced to below the condensation point of the moisture and the moisture therein condensates in the first container 30 thereby increasing its water content. Once it has released its moisture, or at least a component thereof, by condensation, the gas exits the container 30 via conduit 34 and valve 42 and re-enters the re-circulating gas path between the oven and the thermal reactor 20. By operating in this manner moisture can be removed from the system early on and the material within the container 30 becomes pre-heated prior to the start of its processing cycle when it is attached to the oven. The container 30 is maintained at a temperature at which moisture in gas passing therethrough will condensate, preferably below 65° C.

When the sensor 48 senses that the calculated moisture re-circulating within the system is a desired level the valves 42 may be shut to prevent any further reduction of the moisture content of the re-circulating gasses. As the processing cycle continues, moisture re-circulating within the system will react with carbon released from the material being processed and the water content of the re-circulating gasses will drop.

When this is sensed the controller opens the valves 44 thereby opening a flow path for the gas exiting the boiler 24 through the material container 28 and back into the re-circulating gas line. The temperature of the container 28 is maintained above 70° C. so that the introduction of hot gasses thereto via conduit 40 increases, at least locally, the temperature of the material therein to a temperature at which moisture is released therefrom. The gasses exiting the container 28 therefore have a higher moisture content than the gasses entering the container 28 and therefore, in this mode of operation by passing the hot gas exiting downstream of the boiler through the container 28 the moisture level of the gas circulating between the oven and the thermal reactor 20 can be increased.

This method of processing also raises and maintains the temperature in the container 28 to a temperature greater than that of the container 30. The containers progress through the apparatus from left to right so that at the end of a processing cycle the container 12 is removed from the processing chamber and any material therein disposed of according to the type of material, the material container 28 is removed from the hood 32 and is attached to the processing chamber 14, the material container 30 is removed from the hood 32 and takes the place of the container 28 and a new processing container with new material to be processed replaces the position of container 30. While the movement of cartridge 30 from one position to another is described as a physical move it will be well appreciated by the skilled person that through valve manifolding the processing chamber 30 could, alternatively, take the place in the process of chamber 28 without needing to change physical location by the sequence of operating of valves 42 and 44.

At the time the material container 28 is attached to the processing chamber its temperature will preferably have raised to somewhere in the region of 70-120° C., as a result of the flow of hot gas therethrough prior to being attached to the processing chamber, and the majority of the moisture within it will already have been released when it was in its prior position.

As described above, as the majority of the moisture has already been consumed from the material being processed within the container 28 prior to the container being attached to the processing chamber 14 the material that is processed by the oven is a much drier material than is otherwise possible. As the material is much drier, i.e. the moisture has already been removed, a larger mass of dry material can be processed at any one time by the oven.

As will be appreciated by the above description, the additional material containers connected in the system operate as a moisture dump and store to and from which moisture can be selectively removed from the system or added to the system so as to maintain the required moisture balance throughout the cycle of processing a container of material.

The abovementioned system greatly reduces the system energy consumption as, instead of using a lot of initial energy to remove water from the system, and then having to add water later on into the system, with the associated energy cost of evaporating that water, at times of removing moisture from the system the system of the invention utilises the latent heat of condensation of the vapour to pre-heat another batch of material prior to commencement of full processing. Furthermore the process of the invention balances the water consumption throughout the process and eliminates or reduces the need for additional water to be introduced to the system.

It will be appreciated by the skilled person however that as the water content of the material being processed will be variable it may at times be necessary to introduce additional moisture to the system if the starting material is too dry or removes some excess water from the system if the starting material is too wet.

The invention claimed is:

1. A method of processing material such as organically coated waste and organic materials including biomass, industrial waste, municipal solid waste and sludge, the method comprising:

attaching a material container cartridge containing material to be processed to a processing chamber;

heating the material in a reduced oxygen atmosphere in the processing chamber to produce gas;

channelling the gas from the processing chamber to a treatment chamber in which they are heated to destroy any VOC's therein;

recirculating gas from the treatment chamber back into the processing chamber; and in a first mode of operation modifying the moisture content of the gas recirculating from the treatment chamber to the processing chamber by passing it through a second material container cartridge containing material to be processed.

2. The method according to claim 1 wherein the material in the second material container cartridge is at a temperature below 100° C. such that moisture within the gasses condensates in the second material container cartridge thereby reducing the $H_2O$ content of the gas.

3. The method according to claim 2 wherein the temperature of the material in the second material container cartridge is in the range of 20° C. to 65° C.

4. The method according to claim 1 wherein the temperature of the material in the second material container cartridge is raised from its ambient temperature to a temperature not exceeding 65° C. by the recirculating gasses.

5. The method according to claim 1 wherein at least some of the material in the second material container cartridge is raised to a temperature of approximately 100° C. so as to evaporate moisture from the material therein to increase the $H_2O$ content of the gas.

6. The method according to claim 1 further comprising:

in a second mode of operation increasing the $H_2O$ content of the gas by passing the gas recirculating from the treatment chamber to the processing chamber through a third material container cartridge.

7. The method according to claim 6 wherein the temperature of the material in the third material container cartridge is raised to a temperature of approximately 100° C. by the recirculating gasses so as to evaporate moisture from the material therein.

8. The method according to claim 6 further comprising:

in a further mode of operation recirculating gas from the treatment chamber directly to the processing chamber.

9. The method according to claim 6 further comprising:

monitoring the moisture content of the gas and selectively operating in one of the modes of operation to maintain a predetermined moisture content in the gas.

10. The method according to claim 6 further comprising:

monitoring the gas produced in the processing chamber to identify when the material therein is fully processed.

11. The method according to claim 10 further comprising:

when the material in the processing chamber is fully processed, removing the first material container cartridge therefrom and attaching the third material container cartridge to the processing chamber for processing of the material therein.

12. The method according to claim 11 further comprising replacing the third material container cartridge with the second material container cartridge.

13. The method according to claim 12 further comprising replacing the second material container cartridge with a fourth material container cartridge containing material to be processed at ambient temperature.

14. An apparatus for processing material such as organically coated waste and organic materials including: biomass, industrial waste, municipal solid waste and sludge, the apparatus comprising:

a first material container cartridge containing material to be processed;

a processing chamber that receives the first material container cartridge for processing said material therein at an elevated temperature to produce gas;

a treatment chamber for heating the gas so as to destroy any VOC's therein;

a first conduit means between the treatment chamber and the processing chamber for recirculating hot gasses from the treatment chamber to said processing chamber;

a second material container cartridge containing material to be processed;

a second conduit means between the treatment chamber and the processing chamber having the second material container cartridge therein;

control valve means to selectively direct the gasses from the treatment chamber through the first conduit or the second conduit; and a controller to modify the moisture content of the gas by selectively diverting it through the second conduit means.

15. The apparatus according to claim 14 further comprising:

a third material container cartridge containing material to be processed;

a third conduit means between the treatment chamber and the processing chamber having the third material container cartridge therein; wherein the control valve means also selectively directs the gasses from the treatment chamber through the third conduit means; and the controller is configured to decrease the moisture content of the gas by selectively diverting it through the second conduit means and to increase the moisture content of the gas by selectively diverting it through the third conduit means.

16. The apparatus according to claim 14 further comprising:

a moisture sensor for detecting the moisture content of the gas circulating in the system.

17. The apparatus according to claim 14 wherein the controller is configured to operate the valve means to maintain a predetermined moisture content throughout the processing cycle.

* * * * *